United States Patent [19]

Flumm

[11] 4,209,976

[45] Jul. 1, 1980

[54] MEANS OF SETTING A SOLID STATE WATCH

[75] Inventor: Paul T. Flumm, Oakville, Conn.

[73] Assignee: Timex Corporation, Waterbury, Conn.

[21] Appl. No.: 932,973

[22] Filed: Aug. 11, 1978

[51] Int. Cl.[2] ..... G04C 9/00

[52] U.S. Cl. ..... 368/187; 368/61; 368/190

[58] Field of Search ..... 200/153 LB, 61, 39, 200/153 K, 153 P, 153 PA; 58/4, 23 R, 50 R, 33, 85.5, 34

[56] References Cited

U.S. PATENT DOCUMENTS

| | | | |
|---|---|---|---|
| 3,391,258 | 7/1968 | Virnoche | 200/153 LB |
| 3,841,081 | 10/1974 | Komaki | 58/23 R |
| 4,044,543 | 8/1977 | Ikehata et al. | 58/23 R |
| 4,135,359 | 1/1979 | Yajima | 58/85.5 |

*Primary Examiner*—J. V. Truhe
*Assistant Examiner*—Forester W. Isen
*Attorney, Agent, or Firm*—Lawrence Hager

[57] ABSTRACT

A rotate switch mechanism for actuating time correction displayed by an electronic timepiece comprising a rotatable crown and stem, a toothed wheel rotatably connected to the stem and a switch assembly. The switch assembly contains a switch blade precisely positioned within the periphery of the teeth of the toothed wheel and deflected thereby, with rotation of the crown, to make contact with either of two switch contacts.

Circuitry responsive to each switch closure is provided for incrementally effecting time correction, forward and backward, with clockwise and counterclockwise rotation of the crown, respectively.

2 Claims, 4 Drawing Figures

MEANS OF SETTING A SOLID STATE WATCH

BACKGROUND OF THE INVENTION

The present invention relates to a switch mechanism for effecting time correction of an electronic timepiece.

Prior art electronic timepieces, particularly digital watches, typically use a switch(s) to enable the user of the watch to select the desired indicia, e.g., the unit minute or hours, to be adjusted and a second switch device to cause advancement of the indicated time at a predetermined rate. Other prior art timepieces accomplish time correction of the displayed information by rotation of the external operating means to a prescribed position which effects advancement of the selected indicia at a predetermined internal pulse rate with said switch being held in the prescribed position.

The disadvantage of these prior art mechanism are that the use of various push buttons and/or rotate switches for mode select and time correction functions can be confusing to the user. Secondly, the external means is turned to a prescribed angle necessitating extremely cumbersome multi-step operations. Thirdly, these devices enable time correction only by advancement of the displayed time. Further disadvantage involves possibility of undesired results from such operation, user confusion and the high cost of manufacture related with such complex mechanism.

A partial list of prior art patents of interest include U.S. Pat. Nos. 3,975,896 issued Aug. 24, 1976 to Noriyuki Kasama; 3,643,418 issued Feb. 22, 1972 to Herbert S. Polin et al; 4,031,341 issued June 21, 1977 to Paul Wuthrich; 3,418,800 issued Dec. 31, 1968 to Kiyoshi Hashii; 3,653,012 issued Jan. 18, 1972 to Raymond J. Grohoski and British Specification No. 1,461,367 published Jan. 13, 1977 in the name of Kabushiki Kaisha Suwa Seikosha. These prior art patents are merely typical of the art and not in any way intended to be an all inclusive list of pertinent piror art.

In contrast to the prior art, the present invention provides a switch mechanism which enables the user to correct the time being displayed in a forward and backward direction by rotation of the crown in a clockwise and counterclockwise direction, respectively, is adapted for ease of use by the wearer of the watch, involves a minimum of associated parts and enables improved manual control of the rate of time correction with fast or slow rotational manipulation of the crown mechanism.

SUMMARY OF THE INVENTION

Generally speaking, the present invention relates to a switch mechanism for solid state digital watches comprising a rotatable crown and stem, a toothed wheel rotatably connected to the stem and a switch assembly. The switch assembly has a switch blade which is precisely positioned within the periphery of the teeth of the toothed wheel and is deflected thereby, with rotation of the crown, to make contact with either of two switch contacts. Logic circuitry responsive to each switch closure is provided for effecting a predetermined incremental time correction. In this manner, a two-way manually controllable variable rate time correction mechanism is provided Accordingly, an object of this invention is to provide a new and improved displayed time correction mechanism for a solid state watch.

Another object of this invention is to provide a new and improved switch mechanism for effecting forward and reverse time correction of a solid state digital watch with clockwise and counterclockwise rotational movement of a crown.

A further object of this invention is to provide a rotary switch mechanism to enable manually controllable variable rate time correction in a forward and reverse direction time indicating manner.

BRIEF DESCRIPTION OF THE DRAWINGS

Other objects and advantages of this invention may be seen more clearly from the following description when viewed in conjunction with the accompanying drawings wherein.

DETAILED DESCRIPTION OF THE INVENTION

Figure 1:
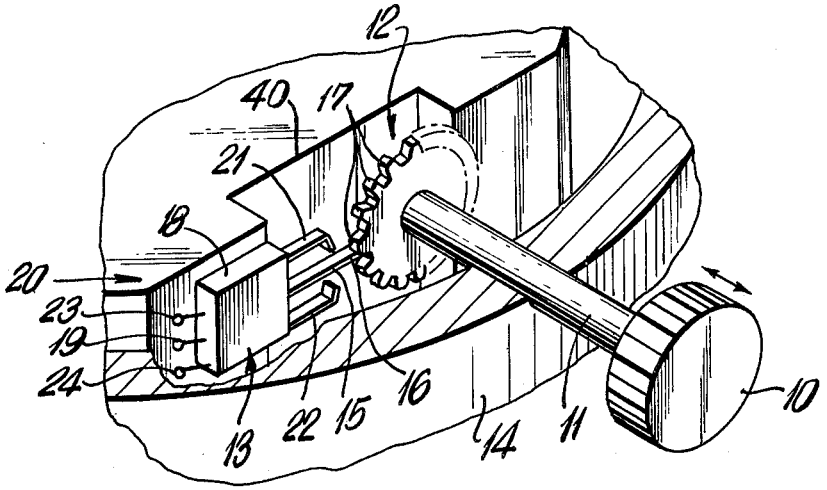
FIG. 1 is a plan view of an embodiment of the switch mechanism in accordance with the invention.
Figure 2:
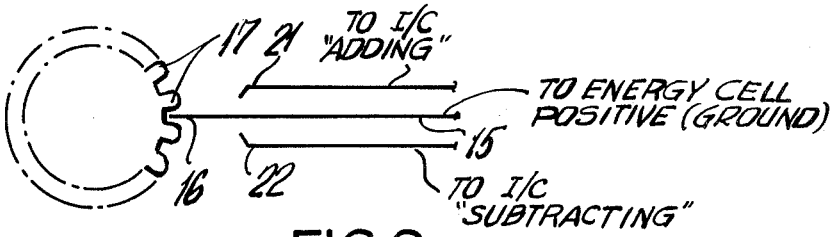
FIGS. 2 and 3 are diagrammatic illustrations of a switching device in accordance with the invention.
Figure 3:
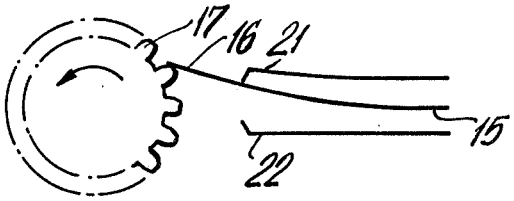

Referring to the drawings, particularly FIGS. 1, 2 and 3, the invention comprises a solid state watch time correction mechanism which includes a rotatable crown 10 and stem 11, a toothed wheel 12 rotatably connected to the stem 11, and a switch assembly 13. The watch crown 10 is affixed to the stem 11 outside the watch case 14.

The internal switching assembly 13 comprises a central spring contact 15 having an end portion or tip 16 being positioned within the periphery of the teeth 17 of the toothed wheel 12, and two spring terminal contacts 21, 22. In the present invention the central spring contact 15 comprises a cantilevered flexible conductive spring contact being mounted at one end, for example, within a plastic housing 18 and electrically connected to a terminal point 19. The plastic switch housing 18 is mounted within the watch to a watch substrate or module assembly 20. The module has a recessed portion 40. The tip 16 of the flexible spring contact 15 is disposed within the peripheral circumference of the teeth 17 for being deflected by the teeth 17 as the crown and stem are rotated clockwise or counterclockwise. The two switch contacts 21, 22 are each mounted at one end to the plastic housing 18 and electrically connected to a terminal point 23, 24 respectively. The two switch contacts 21, 22 are each disposed on either side of the central spring contact 15 and aligned therewith such that electrical contact is made between a switch contact and the central spring contact 15. The terminal points 19, 23 and 24 are coupled to the electronic watch circuitry (not shown) for providing a signal-switch indication of the directional rotation of the crown 10.

The crown 10 and stem 11 are mounted in the case 14 of the watch to enable rotational and axial movement thereof. Since crown and stem mounting techniques for performing these functions are well known to those skilled in the art such as described in the aforementioned patents, exhaustive details thereof are omitted to avoid prolixity.

In the operation of the device shown in FIGS. 1, 2 and 3, the wearer of the watch pulls the crown 10 to an outward position to align teeth 17 for engagement with the spring contact 15. The crown 10 protrudes from the case 14 so that the wearer of the wristwatch may have access to it and permit longitudinal and rotational movement of the shaft. With the crown in the outward position in accordance with the preferred embodiment of this invention, the crown 10 is rotated clockwise or counterclockwise by the wearer. During this motion of the crown, the teeth 17 engage the switch blade 15, deflecting or caming said blade 15 and causing electrical connection between the switch blade 15 and a switch terminal 21 or 22. Each contact between a switch terminal 21 or 22 with the spring contact 15, with clockwise or counterclockwise rotation, causes the displayed unit minutes to increase or decrease, respectively by a predetermined amount. In the preferred embodiment, each contact advances or decreases the displayed unit minutes by one. The toothed wheel 12 contains sixteen teeth (not shown). In this manner, the faster the wearer of the watch rotates the crown 10, the faster the update or time correction is accomplished. The number of teeth 17 may be selected to effect faster or slower time correction with each revolution of the crown.

A second embodiment (not shown) could comprise a crown which is longitudinally fixed in position for engagement of the teeth 17 with the spring contact 15 with rotational movement of the crown.

Another arrangement could be to employ a conductive material for the toothed wheel, and eliminate the necessity for the terminal connection 19. In this instance, the stem and bezel could be employed in a similar manner to that of push button and bezel assemblies used for solid state watches. Thus a conductive circuit would be established to the central contact spring 15, through the toothed wheel, stem and bezel to the grounded side of the energy cell.

The tens of minutes and hours are corrected or set by continuous rotation of the crown. The watch circuitry is provided to advance the tens of minutes digit with each displayed units nine digit being advanced to the zero digit. The same technique is used for correcting the hours digit and tens of hours digit, e.g., the unit hours digit advances a digit with the unit and tens of minutes digits advancing from fifty-nine minutes to zero minutes.

Figure 4:
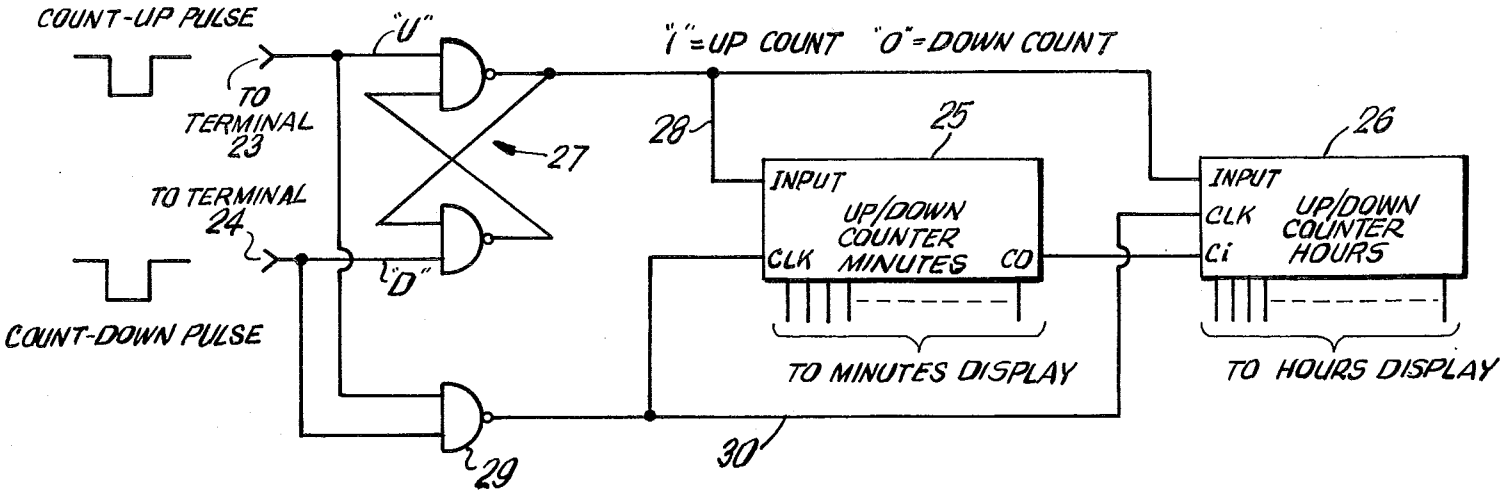
FIG. 4 is a circuit diagram of the control logic of the switch mechanism for use in a timepiece.

FIG. 4 is a block diagram of an electronic circuit for a digital watch according to the present invention. Input pulses "U" and "D" are in their quiescent state, logical "1." Input pulses "U" and "D" are set and clear inputs, respectively to two-gate-latch 27.

A logic state "0" input pulse "U" causes the output of the two-gate-latch 27, signal 28 to assume a logical "1" state. Similarly, a logic state "0" input pulse "D" causes the output of the two-gate-latch 27 to assume a logic "0" state.

The output of two-gate-latch 27 is a counter control signal 28. A logical "1" causes counters 25 and 26 to increment up when pulsed; a logic "0" causes counters 25 and 26 to decrement when pulsed.

Negative pulses on input terminal 23 and 24 are also combined in logical NOR gate 29 to produce a positive pulse on counter clock signal 30 when each negative pulse appears on inputs "U" and "D." Therefore, each time an input pulse "U" occurs, the minutes counter, 25 increments. Similarly, each time an input pulse "D" occurs, the minutes counter, 25 decrements. When the minutes counter 25 goes from a count of fifty-nine to zero, the carry input $C_i$ of counter 26 is incremented by a carry-over ($C_o$) count. Similarly, when the minutes count 25 is down counted to zero, the hours counter 26 and hours indicator, are decreased by one. Since up/-down counters are well known in the art field, they will not be discussed herein to avoid prolixity.

While certain specific embodiments have been set forth for the incentive for the sake of illustration to persons skilled in the art, it is not intended to be limitative.

What is claimed is:

1. A setting mechanism for an electronic watch having an electrooptical digital display for presenting time and a case with an opening for access to the interior thereof which comprises:

a module having a recess portion therein;

a shaft mounted in said opening for rotational and axial movement and having an interior end portion having affixed thereto a single toothed wheel having plurality of teeth spaced on its peripheral surface, said toothed wheel being aligned and dimensioned for being disposed within the recess portion of the module with the shaft being in a first axial position;

switch means having a single cantilevered flexible conductive spring switch blade having an end portion which is disposed for being engaged by the teeth of said toothed wheel with the shaft being in a second axial position and a time incrementing and a time decrementing switch contact each disposed on either side of the switch blade and aligned therewith such that electrical contact is made between the switch blade and either the time incrementing or time decrementing switch contact with upward or downward deflection of the switch blade by the teeth selectively with clockwise and counterclockwise rotation of the shaft; and circuit means responsive to each switch blade contact with the time incrementing switch contact for incrementing the displayed time and to each contact with the time decrementing switch contact for decrementing the displayed time, whereby manual control of the rate of time correction either incrementing or decrementing is effected with fast or slow manual rotation selectively cloclwise and counterclockwise of the shaft.

2. A setting mechanism as in claim 1, wherein:

the toothed wheel has approximately sixteen teeth on its peripheral surface.

* * * * *